US006398474B1

(12) United States Patent
Shmücker et al.

(10) Patent No.: US 6,398,474 B1
(45) Date of Patent: Jun. 4, 2002

(54) METHOD OF MANUFACTURING A BOOK BLOCK WITH A ROUNDED OR A ROUNDED AND PRESSED BACK

(75) Inventors: Christoph Shmücker, Rahden; Karl-Friedrich Schröder, Espelkamp; Reimer Voss, Belm, all of (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 09/652,339

(22) Filed: Aug. 31, 2000

(30) Foreign Application Priority Data

Sep. 4, 1999 (DE) ..... 199 42 359

(51) Int. Cl.[7] ..... B42C 9/00

(52) U.S. Cl. ..... 412/1; 281/21.1; 281/27; 281/40; 281/41; 412/3; 412/6; 412/8; 412/33; 412/37; 412/13

(58) Field of Search ..... 281/21.1, 27, 40, 281/41; 412/1, 3, 6, 8, 33

(56) References Cited

U.S. PATENT DOCUMENTS 3,739,412 A 6/1973 Card et al. ..... 11/5
4,703,951 A * 11/1987 De Gonet ..... 281/27
4,911,475 A * 3/1990 Lerman ..... 281/21.1
5,129,772 A * 7/1992 Slautterback ..... 412/8
5,678,861 A * 10/1997 Werner ..... 281/21.1

FOREIGN PATENT DOCUMENTS

DE 2200082 1/1971 ..... B42C/9/02
DE 40 05 948 A1 2/1990 ..... B42C/5/02

OTHER PUBLICATIONS

Search Report for German Application No. 199 42 359.8, 3 pages.

* cited by examiner

*Primary Examiner*—Willmon Fridie, Jr.
*Assistant Examiner*—Mark T. Henderson
(74) *Attorney, Agent, or Firm*—Alix, Yale & Ristas, LLP

(57) ABSTRACT

A method of manufacturing a book block with a rounded or a rounded and pressed back includes adhering a first plurality of narrow retaining strips along outer leaves and back of the book block. Additional retaining strips may be applied transversely across the back of the book block in the region of the top and bottom of the back of the book block. Thereafter, the book block may be rounded or rounded and pressed. It is believed that application of the retaining strips prior to the rounding and pressing operations reduces the forces of resistance in the rounding and pressing operations.

10 Claims, 2 Drawing Sheets

METHOD OF MANUFACTURING A BOOK BLOCK WITH A ROUNDED OR A ROUNDED AND PRESSED BACK

BACKGROUND OF THE INVENTION

The present invention relates generally to a method of manufacturing a book block with a rounded or a rounded and pressed back. More particularly, the present invention relates to a method of adhering retaining strips to the book block.

For the purpose of manufacturing books having a rounded or pressed back of the book block, it is known for book blocks formed from collated plies to be slip-folded in the adhesive binding machine after the back of the book block has previously been processed and coated with glue over its entire surface. In the process, the slip-folding material is additionally glued to the end papers. The book block prepared in this way is trimmed on three sides and then fed to a book production line.

The coating of the back of the book block with glue over its entire surface, and the slip-folding material applied, impart to the book block a major resisting force against the rounding operation, which force can be overcome only with a great deal of outlay on mechanical engineering. In particular, a preheating section and a performing stations are necessary as well as the actual rounding station to compensate for the resisting force. Also, the rounding operation cannot take place at any speed desired, since the drawing-out of the layer of glue requires a certain amount of time. This results in a restriction on the speed of the machine. In the same way, the resistance of the stiff back of the book block has to be overcome in the pressing operation.

SUMMARY OF THE INVENTION

It is an object of the present invention to provide a method of manufacturing a book block with a rounded or a rounded and pressed back, in which the rounding and pressing of the book block can be performed with a substantially reduced outlay on mechanical engineering.

It is another object to provide a method of manufacturing a book block that results in an increase in the cyclical capacity.

It is further an object to provide a rounding and pressing process that is optimum with regard to the quality of the book block.

These and other objects and advantages of the present invention are achieved by a method of manufacturing a book block having outer leaves and a back including longitudinal edges defined by the longitudinal edge of the leaves, comprising the steps of adhering a first plurality of longitudinal retaining strips to the outer leaves and back of the book block and adhering a second plurality of retaining strips across the back of the book block in a direction which is transverse to the direction of the first plurality of retaining strips.

According to another feature of the invention, the method may also comprise the step of adhering at least one third retaining strip across the back of the book block in a direction which is transverse to the direction of the first plurality of retaining strips.

The book block manufactured in accordance with the invention can be rounded and pressed, either when passing through the machine or while at a standstill. The book block may be rounded and pressed with the aid of elements that are of relatively simple mechanical construction, since the forces of resistance are low and it is not necessary to take into account any;time-dependent operations such as drawing-out of materials. In addition to a cost-effective mode of construction, the cyclical speed in the manufacture of rounded book blocks can also be substantially increased.

BRIEF DESCRIPTION OF THE DRAWINGS

Other objects and advantages of the invention will be evident to one of ordinary skill in the art from the following detailed description made with reference to the accompanying drawings, in which.

DESCRIPTION OF THE PREFERRED EMBODIMENTS

Figure 2:
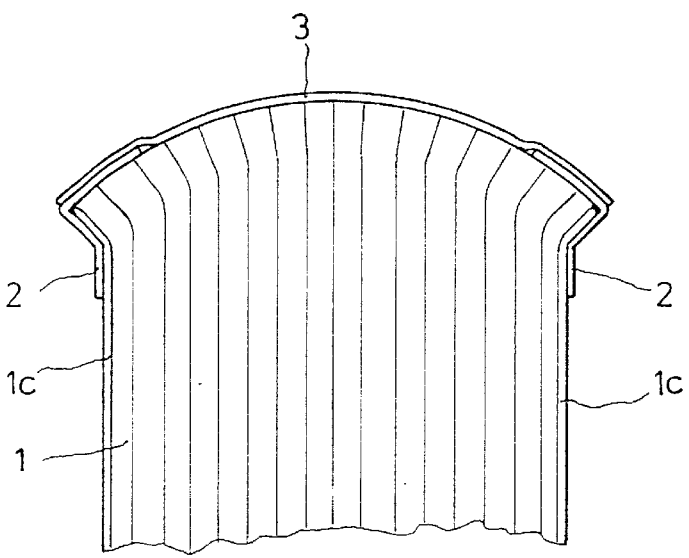
FIG. 2 is an enlarged front elevational view of the book block of FIG. 1 after completion of the rounding and pressing operations.
Figure 1:
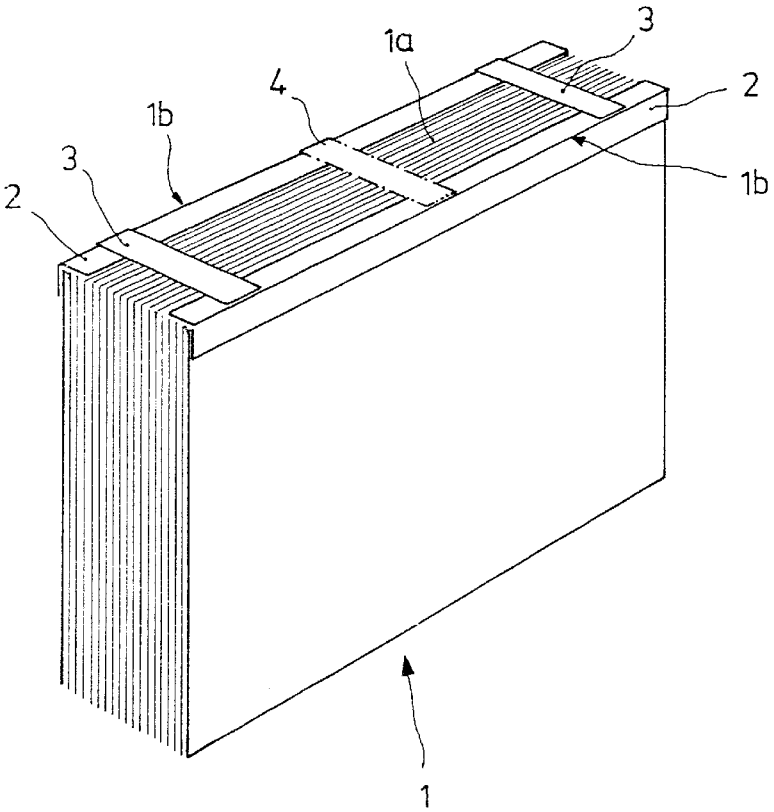
FIG. 1 is a perspective view of a book block in accordance with an embodiment of the present invention.

As illustrated in FIGS. 1 and 2, narrow retaining strips 2 are located along the back of a book block 1 on either side thereof. Each narrow retaining strip 2 spans a longitudinal edge 1*b* of the back and may be glued to the end leaves or papers 1*c* and to the back 1*a* of the book block. Further narrow retaining strips 3, which extend transversely across the back 1*a* of the book block, are glued to the back so as to interconnect the longitudinal strips 2 and are applied at the top and bottom of the back 1*a* of the book block. As can be seen from the perspective view of the book block 1, a large part of the back 1*a* of the book block thus remains exposed, preferably the middle part, irrespective of the thickness of the book block 1, which offers no resistance to the rounding and pressing operations discussed in more detail below. Advantageously, it has been found that the book block 1 is held together by the retaining strips 2 and 3 during transport and during trimming on three sides.

Figure 3:
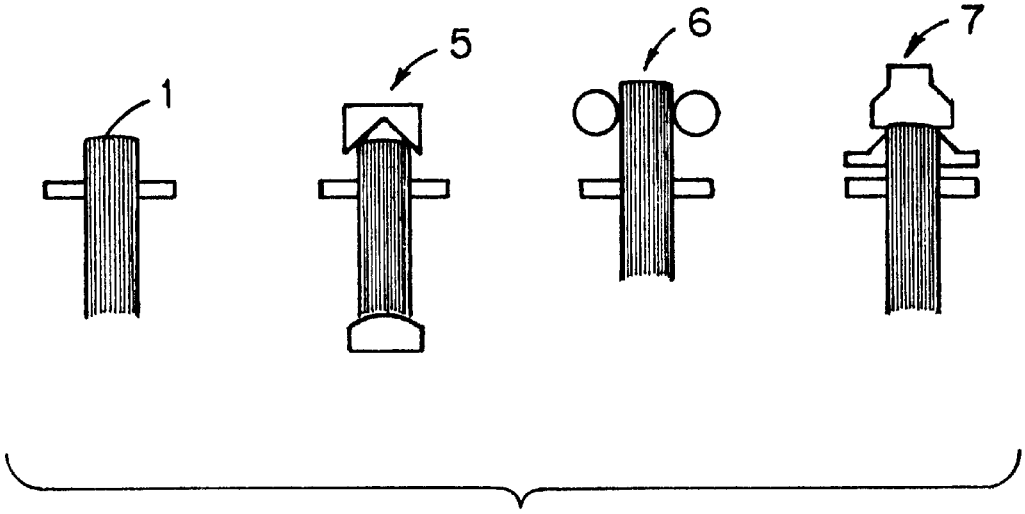
FIG. 3 is a schematic diagram illustrating preshaping, rounding and pressing operations.

As schematically illustrated in FIG. 3, the rounding of the book block 1 can be produced by simply pressing it into a mold or may be preshaped as shown at 5 and rounded as shown at 6. The folded edge can be produced by bending over the outer leaves or plies shown at 7. Further details concerning rounding and pressing of a book block may be found in U.S. patent application Ser. No. 09/470,617, which is hereby incorporated herein by reference.

Referring again to FIGS. 1 and 2, after the subsequent rounding and pressing of the book block 1, the back 1*a* is coated with glue over its entire surface and is thus given its normal stability. The outer leaves or plies continue to hold together because of the retaining strips 2 at the edges 1*b* of the back 1*a* of the book block.

In another embodiment of the present invention, narrow retaining strips 4 may be applied at other points on the back 1*a* of the book block, for example, in the middle of the said back 1*a*. The narrow retaining strips 4 may serve as a transverse safeguard for large-format or thick book blocks 1, as is presented in broken lines in the perspective view.

While preferred embodiments of the foregoing invention have been set forth for purposes of illustration, the foregoing description should not be deemed a limitation of the invention herein. Accordingly, various modifications, adaptations and alternatives may occur to one of ordinary skill in the art without departing from the spirit and scope of the accompanying claims.

What is claimed is:

1. A method of manufacturing a book block having outer leaves and a back including a top end, a bottom end and two longitudinal edges each extending from said top end to said bottom end adjacent to said outer leaves, comprising the steps of:

adhering a longitudinal retaining strip along each of said two longitudinal edges, each of said longitudinal retaining strips extending onto and adhered to a portion of the adjacent one of said outer leaves and extending onto and adhered to a portion of said back whereby said two longitudinal retaining strips are spaced from each other on said back and whereby each longitudinal strip spans a respective one of said two longitudinal edges; and adhering a plurality of spread apart, transverse retaining strips across said back and onto said longitudinal retaining strips to connect said longitudinal retaining strips in a direction which is transverse to said longitudinal retaining strips.

2. The method of claim 1 further comprising the step of rounding the book block.

3. The method of claim 1 further comprising the step of rounding and pressing the book block.

4. The method of claim 1, wherein one transverse retaining strip is adhered near the top end and another transverse retaining strip is adhered near the bottom end of the back of the book block.

5. The method of claim 1 further comprising the step of adhering at least a third retaining strip across the back of the book block and onto the longitudinal retaining strips in a direction which is transverse to the direction of the longitudinal retaining strips.

6. The method claim 1, wherein each of the steps of adhering is carried out by gluing all the retaining strips to the book block.

7. A book block manufactured in accordance with the method of claim 1.

8. The method of claim 5, wherein the step of adhering the at least one third retaining strip comprises locating the at least one third retaining strip at the center between said top and bottom ends of the book block.

9. The method of claim 5, wherein each of the steps of adhering are carried out by gluing all the retaining strips to the book block.

10. A book block manufactured in accordance with the method of claim 5.

* * * * *

UNITED STATES PATENT AND TRADEMARK OFFICE

CERTIFICATE OF CORRECTION

PATENT NO. : 6,398,474 B1
DATED : June 4, 2000
INVENTOR(S) : Schmücker et al.

It is certified that error appears in the above-identified patent and that said Letters Patent is hereby corrected as shown below:

Title page,
Item [75], after "Christoph" delete "Shmücker" and insert -- Schmücker --.

Signed and Sealed this

Twenty-eighth Day of January, 2003

JAMES E. ROGAN
*Director of the United States Patent and Trademark Office*